US010589318B2

(12) United States Patent
Schneider et al.

(10) Patent No.: US 10,589,318 B2
(45) Date of Patent: Mar. 17, 2020

(54) CLASSIFYING POLYSILICON

(71) Applicant: Wacker Chemie AG, Munich (DE)

(72) Inventors: Andreas Schneider, Muehldorf (DE); Peter Gruebl, Eichendorf (DE); Rainer Hauswirth, Kirchdorf (DE); Reiner Pech, Neuoetting (DE)

(73) Assignee: WACKER CHEMIE AG, Munich (DE)

( * ) Notice: Subject to any disclaimer, the term of this patent is extended or adjusted under 35 U.S.C. 154(b) by 347 days.

(21) Appl. No.: 14/917,677

(22) PCT Filed: Aug. 7, 2014

(86) PCT No.: PCT/EP2014/067032

§ 371 (c)(1),
(2) Date: Mar. 9, 2016

(87) PCT Pub. No.: WO2015/032584

PCT Pub. Date: Mar. 12, 2015

(65) Prior Publication Data

US 2016/0214141 A1 Jul. 28, 2016

(30) Foreign Application Priority Data

Sep. 9, 2013 (DE) ..... 10 2013 218 003

(51) Int. Cl.

| | |
|---|---|
| ***B07B 1/46*** | (2006.01) |
| ***B07B 1/00*** | (2006.01) |
| ***B07B 1/28*** | (2006.01) |
| ***B07B 13/18*** | (2006.01) |

(52) U.S. Cl.

CPC ..... *B07B 1/4609* (2013.01); *B07B 1/00* (2013.01); *B07B 1/28* (2013.01); *B07B 1/46* (2013.01); *B07B 13/18* (2013.01); *B07B 2201/04* (2013.01)

(58) Field of Classification Search

CPC .... B07B 1/00; B07B 1/16; B07B 1/28; B07B 1/46; B07B 1/4909; B07B 13/18; B07B 2201/04

USPC ..... 209/233, 315, 319, 353, 355

See application file for complete search history.

(56) References Cited

U.S. PATENT DOCUMENTS

| | | | | |
|---|---|---|---|---|
| 3,857,751 | A * | 12/1974 | Jacobs | B29D 29/06 428/217 |
| 4,107,035 | A * | 8/1978 | Foresman | B07B 1/44 209/309 |
| 4,871,117 | A | 10/1989 | Bauereggar et al. | |
| 5,165,548 | A | 11/1992 | Dumler et al. | |
| 6,375,011 | B1 | 4/2002 | Flottmann et al. | |
| 7,959,008 | B2 | 6/2011 | Von Campe et al. | |
| 8,021,483 | B2 | 9/2011 | Arvidson et al. | |
| 8,833,042 | B2 * | 9/2014 | Wochner | B65B 25/00 53/239 |
| 9,089,847 | B2 * | 7/2015 | Vietz | B02C 23/08 |
| 2007/0235574 | A1 * | 10/2007 | Schaefer | B02C 21/00 241/36 |
| 2009/0081108 | A1 | 3/2009 | Sakai et al. | |
| 2009/0120848 | A1 * | 5/2009 | Schaefer | B07B 1/00 209/577 |
| 2012/0052297 | A1 | 3/2012 | Pech et al. | |
| 2012/0175288 | A1 | 7/2012 | Unland et al. | |
| 2013/0216466 | A1 | 8/2013 | Traunspurger et al. | |
| 2015/0090178 | A1 | 4/2015 | Arvidson et al. | |
| 2015/0283581 | A1 * | 10/2015 | Jones | B07B 1/42 209/369 |
| 2016/0052790 | A1 | 2/2016 | Traunspurger et al. | |

FOREIGN PATENT DOCUMENTS

| | | | |
|---|---|---|---|
| DE | 3811091 | A1 | 10/1989 |
| DE | 10 2010 039 754 | A1 | 3/2012 |
| DE | 10 2012 202 640 | A1 | 8/2013 |
| EP | 1 454 679 | B1 | 9/2004 |
| EP | 1 553 214 | A2 | 7/2005 |
| JP | S59147679 | A | 8/1984 |
| JP | S59166878 | A | 9/1984 |
| JP | H11169795 | A | 6/1999 |
| JP | 2012-532751 | A | 12/2012 |
| JP | 2013-170122 | A | 9/2013 |

OTHER PUBLICATIONS

Matthias Stiess: "Mechanische Verfahrenstechnik," Jan. 1, 2009, Berlin, Heidelberg (English Abstract included) 1 page.

* cited by examiner

*Primary Examiner* — Charles A Fox

*Assistant Examiner* — Kalyanavenkateshware Kumar

(74) *Attorney, Agent, or Firm* — Brooks Kushman P.C.

(57) ABSTRACT

A method for mechanically classifying polycrystalline silicon chunks or granules with a vibratory screening machine, involves setting silicon chunks or granules present on one or more screens each comprising a screen lining in vibration such that the silicon chunks or silicon granules perform a movement which causes the silicon chunks or silicon granules to be separated into various size classes, wherein a screening index is greater than or equal to 0.6 and less than or equal to 9.0.

16 Claims, No Drawings

CLASSIFYING POLYSILICON

CROSS REFERENCE TO RELATED APPLICATIONS

This application is the U.S. National Phase of PCT Appln. No. PCT/EP2014/067032 filed Aug. 7, 2014, which claims priority to German Application No. 10 2013 218 003.9 filed Sep. 9, 2013, the disclosures of which are incorporated in their entirety by reference herein.

BACKGROUND OF THE INVENTION

1. Field of the Invention

The invention relates to a method for classifying polysilicon.

2. Description of the Related Art

Polycrystalline silicon (polysilicon for short) serves as a starting material for production of monocrystalline silicon for semiconductors by the Czochralski (CZ) or zone-melting (FZ) methods, and for production of mono- or multicrystalline silicon by various pulling and casting methods for production of solar cells for photovoltaics.

Polycrystalline silicon is generally produced by means of the Siemens process. This process involves heating support bodies, typically thin filament rods of silicon, by direct passage of current in a bell jar-shaped reactor ("Siemens reactor"), and introducing a reaction gas comprising hydrogen and one or more silicon-containing components. Typically, the silicon-containing component used is trichlorosilane ($SiHCl_3$, TCS) or a mixture of trichlorosilane with dichlorosilane ($SiH_2Cl_2$, DCS) and/or with tetrachlorosilane ($SiCl_4$, STC). Less commonly, but also on the industrial scale, silane ($SiH_4$) is used. The filament rods are inserted vertically into electrodes present at the reactor base, through which they are connected to the power supply. High-purity polysilicon is deposited on the heated filament rods and the horizontal bridge, as a result of which the diameter thereof increases with time. After the rods have been cooled, the reactor bell jar is opened and the rods are removed by hand or with the aid of specific devices, called deinstallation aids, for further processing or for intermediate storage. For most applications, polycrystalline silicon rods are broken into small chunks, which are usually then classified by size.

Polycrystalline silicon granules or granular polysilicon for short is an alternative to the polysilicon produced in the Siemens process. While the polysilicon in the Siemens process is obtained as a cylindrical silicon rod which has to be comminuted to chunks in a time-consuming and costly manner and may need to be cleaned before further processing thereof, granular polysilicon has bulk material properties and can be used directly as raw material, for example for single crystal production for the photovoltaics and electronics industries. Granular polysilicon is produced in a fluidized bed reactor. This is accomplished by fluidization of silicon particles by means of a gas flow in a fluidized bed, the latter being heated to high temperatures by means of a heating device. Addition of a silicon-containing reaction gas results in a pyrolysis reaction at the hot particle surface. This causes deposition of elemental silicon on the silicon particles and growth in the individual particle diameter. Through the regular removal of particles that have increased in size and addition of small silicon particles as seed particles, it is possible to operate the process continuously with all the associated advantages. Silicon-containing reactant gases used may be silicon-halogen compounds (e.g. chlorosilanes or bromosilanes), monosilane ($SiH_4$), and mixtures of these gases with hydrogen.

After they have been produced, the polycrystalline silicon granules are divided into two or more fractions by means of a screening system.

The smallest screen fractions (screen undersize) can subsequently be processed in a grinding system to give seed particles and added to the reactor.

The target screen fraction is typically packed.

US 2009081108 A1 discloses a workbench for manual sorting of polycrystalline silicon by size and quality. This implements an ionization system to neutralize electrostatic charges by active air ionization. Ionizers permeate the cleanroom air with ions such that static charges at insulators and ungrounded conductors are dissipated.

Typically, screening machines are used to sort or to classify polycrystalline silicon into different size classes after comminution. A screening machine is generally a machine for screening, i.e. separation of solid mixtures by particle size. A distinction is made by the movement characteristics between planar vibratory screening machines and gravity screening machines. The screening machines are usually driven electromagnetically or by imbalance motors or drives. The movement of the screen lining serves to transport the material applied onward in the longitudinal direction of the screen, and for passage of the fines fraction through the mesh orifices.

In contrast to planar vibratory screening machines, a vertical screen acceleration also occurs as well as the horizontal screen acceleration in gravity screening machines. In the gravity screening machines, vertical throwing motions are combined with gentle rotary motions. The effect of this is that the sample material is distributed over the whole area of the screen deck and the particles simultaneously experience acceleration in the vertical direction (are thrown upward). In the air, they can perform free rotations and, when they fall back down onto the screen, are compared with the meshes of the screen fabric. If the particles are smaller than these, they pass through the screen; if they are larger, they are thrown upward again. The rotating motion ensures that they will have a different orientation the next time they hit the screen fabric, and thus will perhaps pass through a mesh orifice after all.

In planar screening machines, the screening tower performs a horizontally circular motion in a plane. As a result, the particles for the most part retain their orientation on the screen fabric. Planar screening machines are preferably used for acicular, platelet-shaped, elongated or fibrous screening materials where throwing of the sample material upward is not necessarily advantageous.

A specific type is the multideck screening machine, which can simultaneously fractionate several particle sizes. They are designed for a multitude of sharp separations in the mid-grain to ultrafine-grain range. The drive principle in multideck planar screening machines is based on two imbalance motors running in opposite directions, which generate a linear vibration. The screening material moves in a straight line over the horizontal separation surface. The machine works with low vibratory acceleration.

The drive principle in multideck planar screening machines is based on two imbalance motors running in opposite directions, which generate a linear vibration. The screening material moves in a straight line over the horizontal separation surface. The machine works with low vibratory acceleration.

Through a building block system, a multitude of screen decks can be assembled to form a screen stack. Thus, if required, different particle sizes can be produced in a single machine without needing to change screen linings. Through multiple repetition of identical screen deck sequences, it is possible to make a large amount of screen area available to the screening material.

U.S. Pat. No. 8,021,483 B2 discloses an apparatus for sorting polycrystalline silicon pieces, comprising a vibratory motor assembly and a step deck classifier mounted to the vibratory motor assembly. The vibratory motor assembly ensures that the silicon pieces move over a first deck comprising grooves. In a fluidized bed region, dust is removed by an air stream through a perforated plate. In a profiled region of the first deck, the silicon pieces settle into the troughs of the grooves or remain on top of the crests of the grooves. As the polycrystalline silicon pieces reach the end of the first deck, silicon pieces smaller than the gap fall through the gap and onto a conveyor belt. Larger silicon pieces pass over the gap and fall onto the second deck. The parts of the apparatus that come into contact with the polycrystalline silicon pieces consist of materials that minimize contamination of silicon. Examples mentioned include tungsten carbide, PE, PP, PFA, PU, PVDF, PTFE, silicon and ceramic.

US 2007235574 A1 discloses a device for comminuting and sorting polycrystalline silicon, comprising a means for feeding a coarse polysilicon fraction into a crushing system, the crushing system, and a sorting system for classifying the crushed polysilicon fraction, wherein the device is provided with a controller which allows variable adjustment of at least one crushing parameter in the crushing system and/or at least one sorting parameter in the sorting system. The sorting system more preferably consists of a multistage mechanical screening system and a multistage optoelectronic separating system. Vibrating screen machines are preferably used, which are driven by an unbalance motor. Meshed and perforated screens are preferred as a screen lining.

The screening stages may be arranged in series or in another structure, for example a tree structure. The screens are preferably arranged in three stages in a tree structure. The crushed polysilicon fraction freed from fine components is preferably sorted by means of an optoelectronic separating system. The polysilicon fraction may be sorted according to all criteria which are known in image processing in the prior art. It is preferably carried out according to one to three criteria selected from the group of length, area, shape, morphology, color and weight of the polysilicon fragments, more preferably length and area.

This enables the production of the following fractions:

Fraction 0: chunk sizes with a distribution of approximately 0 to 3 mm

Fraction 1: chunk sizes with a distribution of approximately 1 mm to 10 mm

Fraction 2: chunk sizes with a distribution of approximately 10 mm to 40 mm

Fraction 3: chunk sizes with a distribution of approximately 25 mm to 65 mm

Fraction 4: chunk sizes with a distribution of approximately 50 mm to 110 mm

Fraction 5: chunk sizes with a distribution of approximately >90 mm to 250 mm

There is no information as to the exact distribution of the chunk sizes within the fractions in US 2007235574 A1.

U.S. Pat. No. 5,165,548 A discloses a device for separating semiconductor grade silicon pieces by size, comprising a cylindrical screen contacted with a means for rotating the cylindrical screen, where the screen surfaces that come into contact with the silicon pieces consist essentially of semiconductor grade silicon.

U.S. Pat. No. 7,959,008 B2 claims a method for screening first particles out of a granulate comprising first and second particles by conveying the granulate along a first screen surface preferably emanating from a vibration unit, wherein the first particles have an aspect ratio a1 where a1>n:1 and n=2, 3, >3, especially with a1>3:1, and the dimensions of the second particles allow them to fall through the mesh of the first screen surface, wherein the granulate is conveyed along the screen surface between said surface and a cover which extends along the screen surface, and the cover causes the first particles to be aligned with their longitudinal axes extending along the screen surface, wherein the longitudinal extension of each first particle is greater than the mesh width of the screen which forms the first screen surface, and the longitudinal extension of the second particles is equal to or smaller than the mesh width.

EP 1454679 B1 describes a screening apparatus having a first vibrating body provided with first crossmembers, and a second vibrating body provided with second crossmembers, which first and second crossmembers are positioned in alternation and have clamping devices so that elastic screen linings may be clamped between one first crossmember and one second crossmember in each case, and have a drive unit which is directly coupled to the first vibrating body and by means of which the first vibrating body is positively driven, so that the clamped elastic screen linings are moved back and forth between a stretched position and a contracted position, the second vibrating body being positively driven with respect to the first vibrating body.

U.S. Pat. No. 6,375,011 B1 discloses a method for conveying silicon fragments wherein the silicon fragments are guided over a conveyor surface, which is made from hyperpure silicon, of a vibrating conveyor. In the course of this method, sharp edged silicon fragments become rounded when they are conveyed on the vibrating conveyor surface of a vibrating conveyor. The specific surface areas of the silicon fragments are reduced; contamination adhering to the surface is ground off. The silicon fragments which have been rounded by means of a first vibrating conveyor unit can be guided over a second vibrating conveyor unit. The conveyor surface thereof consists of hyperpure silicon plates which are arranged parallel to one another and are fixed by means of side attachment fittings. The hyperpure silicon plates have passage openings, for example in the form of apertures. The conveying edges, which serve to laterally delimit the conveyor surfaces, are likewise made from hyperpure silicon plates and are fixed, for example, by holding-down means. The conveyor surfaces, which are made from hyperpure silicon plates, are supported by steel plates and, if appropriate, shock-absorbing mats.

US 2012052297 A1 discloses a method for producing polycrystalline silicon, comprising fracturing into fragments polycrystalline silicon deposited on thin rods in a Siemens reactor, classifying the fragments into size classes of from about 0.5 mm to more than 45 mm, treating the silicon fragments with compressed air or dry ice to remove silicon dust from the fragments without wet chemical cleaning. The polycrystalline silicon is classified as follows: chunk size 0 (CS0) in mm: about 0.5 to 5; chunk size 1 (CS1) in mm: about 3 to 15; chunk size 2 (CS2) in mm: about 10 to 40; chunk size 3 (CS3) in mm: about 20 to 60; chunk size 4 (CS4) in mm: about >45; with at least 90% by weight of the chunk fraction within each size range mentioned. This corresponds to the specification of the different chunk sizes into which the silicon is to be classified. The application does not give any information as to the actual result of the classification or sorting of the silicon and the size distributions within the individual size classes.

US 2009120848 A1 describes a device which enables flexible classification of crushed polycrystalline silicon, which comprises a mechanical screening system and an optoelectronic sorting system, the polycrystalline silicon fragments being separated into a fine silicon component and a residual silicon component by the mechanical screening system and the residual silicon component being separated into further fractions by means of an optoelectronic sorting system. The mechanical screening system is preferably a vibratory screening machine which is driven by an imbalance motor.

In the course of mechanical classification by screening by means of vibratory screening machines according to the prior art, material worn away from the screen lining is introduced into the product. This results in contamination of the polysilicon with constituents present in the screen lining. Another disadvantage in the prior art is that the fractions into which the polysilicon is classified have a distinct overlap. In the prior art, a certain overlap in the specifications has already been accepted.

In US 2012052297 A1, the overlap between chunk size 2 and chunk size 1 is max. 5 mm, and that between chunk size 1 and chunk size 0 is max. 2 mm. This relates to the specification to which classification is to be effected. The actual distribution of the chunk sizes is generally different from this.

According to US 2007235574 A1, the overlap between a fraction 1 and a fraction 0 is likewise max. 2 mm. Particularly in the case of fractions with smaller chunk sizes of 30 mm or less, such an overlap is undesirable.

This problem gave rise to the objective of the invention.

SUMMARY OF THE INVENTION

An object of the invention is achieved by a method for mechanically classifying polycrystalline silicon chunks or granules with a vibratory screening machine, by setting silicon chunks or granules present on one or more screens, in vibration, each screen comprising a screen lining such that the silicon chunks or silicon granules perform a movement which causes the silicon chunks or silicon granules to be separated into various size classes, wherein a screening index is greater than or equal to 0.6 and less than or equal to 9.0.

DETAILED DESCRIPTION OF THE PREFERRED EMBODIMENTS

The screening index is defined as the ratio of the acceleration generated by the screening motion to the acceleration due to gravity vertical to the screening plane:

$$K_v = r^*\omega^{2*}\sin(\alpha+\beta)/(g^*\cos(\beta)),$$

where r: amplitude of vibration;

ω: angular velocity;

α: throwing angle;

β angle of screen inclination;

g: gravitational constant.

This indicates the maximum vertical acceleration of an object relative to the earth's gravitational acceleration g. If the screening index is <1, there is pure sliding motion (without throwing motion), since the resulting vertical acceleration is smaller than gravitational acceleration. For A throwing motion, the screening index must be >1.

It has been found that, surprisingly, both processes having a screening index of less than 0.6 and processes having a screening index of greater than 9.0 result in much poorer screening results than within the inventive range of 0.6-9.0.

Preferably, the screening index is greater than or equal to 0.6 and less than or equal to 5.0. Classifying at a screening index of 0.6 to 5.0 achieved a further improvement in the screening results. More particularly, the separation sharpness is better than at a screening index of greater than 5.0.

More preferably, the motion of chunk or granular silicon is a throwing motion, with a screening index of 1.6 to 3.0. It has been found that another improvement in screening results, more particularly an even higher separation sharpness between the different size classes, is achieved as a result.

The amplitude of vibration is preferably 0.5 to 8 mm, more preferably 1 to 4 mm. The speed of rotation $\omega/2\pi$ is preferably 400 to 2000 rpm, more preferably 600 to 1500 rpm. The throwing angle is preferably 30 to 60°, more preferably 40 to 50, and the angle of screen inclination relative to the horizontal is preferably 0 to 15°, more preferably 0 to 10°.

The screening machine preferably comprises a feed region in which the screening material is introduced, and an outlet region in which classified screening material is conducted away.

Preferably, the size of the screen orifices increases in the outlet direction. Fractions/chunk sizes are preferably separated by means of outlets arranged in series.

Preferably, the screening machine comprises screen decks arranged one on top of another. This has the advantage that large chunks cannot damage fine-mesh screen linings. Preferably, fractions/chunk sizes are separated by outlets arranged one on top of another.

Preferably, the screening machine comprises a frame/screen system. This enables rapid screen changing. Monitoring of any contamination is also facilitated. A frame/screen system of this kind comprises screw connection, adhesive bonding, insertion or casting of screen linings in frames, the frames consisting of wear-resistant plastic (preferably PP, PE, PU), optionally with steel reinforcement, or at least being lined with wear-resistant plastic. The frames are preferably sealed by being braced vertically. It is thus possible to avoid contamination and material loss.

It is preferable to use screen linings of particularly wear-resistant plastics, namely elastomers having a Shore A hardness of greater than 65, more preferably having a Shore A hardness of greater than 80. Shore hardness is defined in standards DIN 53505 and DIN 7868. It is possible here for one or more screen linings or surfaces thereof to consist of such an elastomer.

Either one or more screen linings or surfaces thereof or all the components and linings that make contact with the product preferably consist of plastics having a total contamination (metals, dopants) of less than 2000 ppmw, preferably less than 500 ppmw and more preferably less than 100 ppmw.

The maximum contamination of the plastics with the elements Al, Ca, P, Ti, Sn and Zn should be less than 100 ppmw, more preferably less than 20 ppmw.

The maximum contamination of the plastics with elements Cr, Fe, Mg, As, Co, Cu, Mo, Sb and W should be less than 10 ppmw, more preferably less than 0.2 ppmw. The contaminations are determined by means of ICP-MS (mass spectrometry with inductively coupled plasma).

Preferably, the screen linings made of plastics comprise a reinforcement or filling composed of metals, glass fibers, carbon fibers, ceramic or composite materials for stiffening.

Preferably, the screening material is dedusted. The mechanical screening mobilizes the majority of the fine dust adhering to the bulk material on the individual screen decks. This effect is utilized in the invention in order to dedust the bulk material during the screening process.

What is important here is that the fine dust released is transported into an offgas pathway through an appropriate gas flow, in order that it cannot get back into the product. The gas flow can be generated either by suction or by a gas purge. Suitable sifting gases are cleaned air, nitrogen or other inert gases. In the screening machine, there should be a gas velocity of 0.05 to 0.5 m/s, more preferably of 0.2 to 0.3 m/s. A gas velocity of 0.2 m/s can be established, for example, with a gas throughput or a suction performance of 720 $m^3$ (STP)/h per $m^2$ of screen area. Fine dust is understood to mean particles smaller than 10 μm.

As well as dedusting in the screening machine, dedusting is optionally conducted by means of countercurrent wind sifting in the removal lines for the individual screen fractions. This involves feeding in the sifting gas in the lower region of the removal lines and conducting the dust-laden offgas away in the upper region, immediately upstream of the screening machine. Useful sifting gases are again the abovementioned media. The advantage of this dedusting method is that the sifting stream can be matched to the particle size of the screen fraction. In the case of a coarse screen fraction, it is possible, for example, to set a high sifting flow rate without discharging fine product as well. This gives a very good dedusting outcome and the desired low fine dust fraction in the product.

Preferably, the rotational speed is increased temporarily up to 4000 rpm, in order to free the screen linings from lodged grains. For this purpose, it is alternatively also possible to increase the amplitude of vibration temporarily to up to 15 mm. It is likewise preferable to use impact balls made from plastic or ultrapure silicon, in order to free the screen linings from lodged grains.

Preferably, the amplitude of vibration decreases toward the outlet. More preferably, the ratio of the amplitude of vibration at the exit is up to 50% lower than at the inlet. It has been found that this can further reduce both wear and product contamination.

Useful types of drive for the screening machine include linear, circular or elliptical oscillators. The drive preferably provides a vertical acceleration component in order to reduce screen wear and avoid lodged particles.

It is preferable to use particular shapes for the screen orifices.

Advantageous shapes have been found to be rectangular orifices. Lower wear is found as a result of smaller contact areas. Lodged/jammed grains can be avoided more easily. Round orifices, in contrast, lead to a higher separation sharpness with respect to particle size. Square orifices are likewise preferable. These can combine advantages of rectangular and round orifices.

Preferably, the screen trough and the screen outlets are lined completely on the inside with silicon or with a thermoplastic or elastomer.

Steel base structures of the screening machines are preferably provided with welded PP lining segments. Preference is also given to the use of inner PU linings.

Particularly suitable lateral linings have been found to be steel-reinforced PU castings.

The screen frames can preferably be fixed using quick-release devices.

It is also preferable to use perforated silicon fillets as the screen lining. It is possible for one or more screen linings to be configured in this way. These preferably comprise square bars of ultrapure silicon provided with holes. These holes preferably have a conical shape at least in part, meaning that a cross-sectional area at the top is smaller than at the bottom. This contributes to avoidance of lodged grains. The cone preferably has an angle of 1 to 20°, more preferably 1 to 5°. Preferably, edge rounding of the holes with a radius of 0.1 to 2 mm is provided at the top of the screen, in order to prevent loss of material and wear, which would lead to deterioration in the separation sharpness. Preferably, only the lower part of each hole is conical and the other part is cylindrical, in order that the hole is not widened too quickly as a result of wear.

Preference is given to providing plastic-sheathed metal support fillets for stabilization in the event of fracture of the Si fillets, for avoidance of contamination and for safeguarding against losses of chunks in the event of fillet fracture.

Preferably, individual Si fillets are equipped with concluding cemented carbide fillets, which are clamped horizontally or vertically. Thus, inexpensive exchange of individual fillets according to wear is possible. The cemented carbide used is preferably WC, SiC, SiN or TiN.

Preferably, the perforated Si screen is laid onto, bonded to or screwed onto a substrate. This enables higher strength; larger areas and the use of thinner or thicker screens is possible. Fracture is easier to avoid.

It is most preferable to use both perforated Si screens and screens made from plastic or screens having a plastic lining.

Preferably, the first screen cut used is a perforated Si screen having a hole diameter of 5 mm to 50 mm. In this case, the large chunks are able to clear away jammed grains and hence prevent blockage. For further separation of the fines fractions, one or more screens made from plastic or having plastic linings are used.

Preferably, for chunk silicon having particle sizes of greater than 15 mm (max. particle length), an additional pre-screen having a plastic lining and having a mesh ratio relative to the screen deck beneath of 1.5:1 to 10:1 is used. This can reduce plastic wear on the lower screen deck. The outputs from the two screen decks are combined. The pre-screen deck preferably has a lower screen stress. This serves to minimize wear.

The method of the invention (throwing motion, screen index 1.6-3.0) leads to polycrystalline silicon chunks having a sharp particle size distribution without any great overlap, or to polycrystalline silicon granules classified with a high separation sharpness, which was not achievable as such in the prior art to date.

The invention therefore also relates to classified polycrystalline silicon chunks, characterized by a particle size classification into chunk size classes 2, 1, 0 and F, where the following applies to the chunks: chunk size 2 has max. 5% by weight smaller than 11 mm and max. 5% by weight larger than 27 mm; chunk size 1 has max. 5% by weight smaller than 3.7 mm and max. 5% by weight larger than 14 mm; chunk size 0 has max. 5% by weight smaller than 0.6 mm and max. 5% by weight larger than 4.6 mm; chunk size F has max. 5% by weight smaller than 0.1 mm and max. 5% by weight larger than 0.8 mm.

The chunk size is defined as the longest distance between any two points on the surface of a silicon chunk (=max. length).

The following chunk sizes are found:
chunk size F (CS F) in mm: 0.1 to 0.8;
chunk size 0 (CS 0) in mm: 0.6 to 4.6;
chunk size 1 (CS 1) in mm: 3.7 to 14;
chunk size 2 (CS 2) in mm: 11 to 27.

In each case, at least 90% by weight of the chunk fraction is within the size range mentioned. This results in an overlap range of the 5% by weight quantile of the coarse chunk size to the 95% by weight quantile of the fine chunk size of:
chunk size 2 to chunk size 1: max. 3 mm;
chunk size 1 to chunk size 0: max. 0.9 mm;
chunk size 0 to chunk size F: max. 0.2 mm.

The polycrystalline silicon chunks having the improved particle size classification preferably have very low surface contamination:
Tungsten (W):
chunk size 1≤100,000 pptw, more preferably ≤20,000 pptw;
chunk size 0≤1,000,000 pptw, more preferably ≤200,000 pptw;
chunk size F≤10,000,000 pptw, more preferably ≤2,000,000 pptw;
Cobalt (Co):
chunk size 2≤5000 pptw, more preferably ≤500 pptw;
chunk size 1≤50,000 pptw, more preferably ≤5000 pptw;
chunk size 0≤500,000 pptw, more preferably ≤50,000 pptw;
chunk size F≤5,000,000 pptw, more preferably ≤500,000 pptw;
Iron (Fe):
chunk size 2≤50,000 pptw, more preferably ≤1000 pptw;
chunk size 1≤500,000 pptw, more preferably ≤10,000 pptw;
chunk size 0≤5,000,000 pptw, more preferably ≤100,000 pptw;
chunk size F≤50,000,000 pptw, more preferably ≤1,000,000 pptw;
Carbon (C):
chunk size 2≤1 ppmw, more preferably ≤0.2 ppmw;
chunk size 1≤10 ppmw, more preferably ≤2 ppmw;
chunk size 0≤100 ppmw, more preferably ≤20 ppmw;
chunk size F≤1000 ppmw, more preferably ≤200 ppmw;
Cr, Ni, Na, Zn, Al, Cu, Mg, Ti, K, Ag, Ca, Mo, for each individual element:
chunk size 2≤1000 pptw, more preferably ≤100 pptw;
chunk size 1≤2000 pptw, more preferably ≤200 pptw;
chunk size 0≤10,000 pptw, more preferably ≤1000 pptw;
chunk size F≤100,000 pptw, more preferably ≤10,000 pptw;
Fine dust (silicon particles having a size of less than 10 μm):
chunk size 2≤5 ppmw, more preferably ≤2 ppmw;
chunk size 1≤15 ppmw, more preferably ≤5 ppmw;
chunk size 0≤25 ppmw, more preferably ≤10 ppmw;
chunk size F≤50 ppmw, more preferably ≤20 ppmw.

The invention also relates to classified polycrystalline silicon granules, classified at least into the two size classes of screen target size and screen undersize, with a separation sharpness between screen target size and screen undersize of more than 0.86.

Preference is given to classified polycrystalline silicon granules, classified into screen target size, screen undersize and screen oversize, with a separation sharpness between screen target size and screen undersize and between screen target size and screen oversize of more than 0.86 in each case.

Classified polycrystalline silicon granules preferably have the following contaminations by metals at the surface: Fe: <800 pptw, more preferably <400 pptw; Cr: <100 pptw, more preferably <60 pptw; Ni: <100 pptw, more preferably <50 pptw; Na: <100 pptw, more preferably <50 pptw; Cu: <20 pptw, more preferably <10 pptw; Zn: <2000 pptw, more preferably <1000 pptw.

Classified polycrystalline silicon granules preferably have contamination by carbon at the surface of less than 10 ppmw, more preferably less than 5 ppmw.

Classified polycrystalline silicon granules preferably have contamination by fine dust at the surface of less than 10 ppmw, more preferably less than 5 ppmw. Fine dust is defined as silicon particles having a size of less than 10 μm.

EXAMPLES AND COMPARATIVE EXAMPLES

The advantages of the invention are shown hereinafter by examples and comparative examples.

Example 1 and comparative example 2 relate to the classifying of polycrystalline silicon chunks into chunk sizes 2, 1, 0 and F.

Example 3 and comparative example 4 relate to the classifying of polycrystalline silicon granules (screen target size 0.75-4 mm).

Example 1

Table 1a shows the main parameters of the screening machine.

TABLE 1a

| | |
|---|---|
| Screen width b [mm] | 600 |
| Screen length l [mm] | 1600 |
| Frequency n [Hz] | 25 |
| Rotational speed [rpm] | 1500 |
| Angular velocity ω [1/s] | 157.1 |
| Stroke [mm] | 3 |
| Amplitude r [mm] | 1.5 |
| Angle of inclination β [°] | 0 |
| Throwing angle α [°] | 50 |
| Screening index Kv [—] | 2.9 |
| Throughput [kg/h] | 700 |
| $N_2$ sifting gas [$m^3$ (STP)/h] | 50 |

Table 1b shows which screen set was used in the example. Three screen decks with different mesh sizes of the screens were used.

TABLE 1b

| | Mesh size [mm] | Material |
|---|---|---|
| Deck 1 | 9 | polyurethane |
| Deck 2 | 1.9 | polyamide |
| Deck 3 | 0.3 | polyamide |

Table 1c shows the composition of the screen linings.

TABLE 1c

| Element | Polyurethane: | Polyamide: |
|---|---|---|
| Al [ppmw] | 17 | 0.7 |
| Ca [ppmw] | 14 | 9.1 |
| Cr [ppmw] | <0.2 | 0.3 |
| Fe [ppmw] | 0.7 | 0.9 |
| K [ppmw] | 0.7 | <0.2 |
| Mg [ppmw] | 0.4 | 0.2 |
| Na [ppmw] | 0.3 | 0.6 |
| P [ppmw] | 63 | <20 |
| Sn [ppmw] | 5.4 | <0.2 |
| Ti [ppmw] | 570 | 0.2 |
| Zn [ppmw] | 8.5 | <0.2 |

TABLE 1c-continued

| Element | Polyurethane: | Polyamide: |
|---|---|---|
| As, B, Ba, Cd, Co, Cu, Li, Mn, Mo, Ni, Sr, V [ppmw] | <0.2 | <0.2 |
| Be, Bi, Pb, Sb, W [ppmw] | <0.2 | <0.2 |

The screening results achieved with respect to particle size distribution are shown in tables 1d and 1e.

TABLE 1d

| | Chunk size 2 | Chunk size 1 | Chunk size 0 | Chunk size F |
|---|---|---|---|---|
| 5% by weight length quantile: [mm] | 11.3 | 3.9 | 0.65 | 0.12 |
| 95% by weight length quantile: [mm] | 26.7 | 13.9 | 4.4 | 0.72 |

TABLE 1e

| | CS 2/1 | CS1/0 | CS0/F |
|---|---|---|---|
| Overlap of 5% by weight/ 95% by weight [mm] | 2.6 | 0.5 | 0.07 |

Table 1f shows the contaminations of the classified chunks by surface metals, carbon, dopants and fine dust.

TABLE 1f

| Metals, carbon, dopants, fine dust | Chunk size 2 | Chunk size 1 | Chunk size 0 | Chunk size F |
|---|---|---|---|---|
| Fe [pptw] | 80 | 170 | 1200 | 12,800 |
| Cr [pptw] | 10 | 60 | 270 | 7300 |
| Ni [pptw] | <10 | 10 | 110 | 5400 |
| Na [pptw] | 20 | 40 | 430 | 6300 |
| Zn [pptw] | <10 | 40 | 210 | 5000 |
| Al [pptw] | 30 | 80 | 40 | 6200 |
| Cu [pptw] | <10 | <10 | 30 | <5000 |
| Mg [pptw] | <10 | 20 | 70 | 5600 |
| Ti [pptw] | <10 | 20 | 170 | <5000 |
| W [pptw] | 1500 | 6340 | 57,600 | 969,000 |
| K [pptw] | 20 | 10 | 160 | <5000 |
| Ag [pptw] | <10 | <10 | <10 | <5000 |
| Ca [pptw] | 60 | 110 | 350 | <5000 |
| Co [pptw] | 270 | 730 | 9300 | 135,000 |
| V [pptw] | <10 | 10 | 130 | <5000 |
| Pb [pptw] | <10 | <10 | 90 | <5000 |
| Zr [pptw] | <10 | <10 | 860 | <5000 |
| Mo, As, Be, Bi, Cd, In, Li, Mn, Sn [pptw] | <10 | <10 | <10 | <5000 |
| C [ppbw] | 72 | 278 | 896 | 5857 |
| B [pptw] | 6 | 15 | 41 | 106 |
| P [pptw] | 35 | 131 | 208 | 574 |
| As [pptw] | 3 | 7 | 15 | 51 |
| Fine dust (<10 μm) [ppmw] | 1.9 | 3.8 | 8.4 | 17.2 |

Comparative Example 2

Table 2a shows the essential parameters of the screening machine used therefor.

TABLE 2a

| | |
|---|---|
| Screen width b [mm] | 600 |
| Screen length l [mm] | 1600 |

TABLE 2a-continued

| | |
|---|---|
| Frequency n [Hz] | 20 |
| Rotational speed [rpm] | 1200 |
| Angular velocity ω [1/s] | 125.7 |
| Stroke [mm] | 2.4 |
| Amplitude r [mm] | 1.2 |
| Angle of inclination β [°] | 0 |
| Throwing angle α [°] | 45 |
| Screening index Kv [—] | 1.4 |
| Throughput [kg/h] | 700 |
| $N_2$ sifting gas [$m^3$ (STP)/h] | NN |

Table 2b shows which screen set was used in comparative example 2. Three screen decks with different mesh sizes of the screens were used.

TABLE 2b

| | Mesh size [mm] | Material |
|---|---|---|
| Deck 1 | 9 | polyurethane |
| Deck 2 | 1.9 | polyamide |
| Deck 3 | 0.3 | polyamide |

Table 2c shows the composition of the screen linings used.

TABLE 2c

| Element | Polyurethane: | Polyamide: |
|---|---|---|
| Al [ppmw] | 43 | 2.3 |
| Ca [ppmw] | 35 | 44 |
| Cr [ppmw] | <0.2 | 2.0 |
| Fe [ppmw] | 4.5 | 4.7 |
| K [ppmw] | 5.1 | 0.6 |
| Mg [ppmw] | 2.6 | 0.8 |
| Na [ppmw] | 3.8 | 6.1 |
| P [ppmw] | 114 | 28 |
| Sn [ppmw] | 18 | 1.1 |
| Ti [ppmw] | 1220 | 0.7 |
| Zn [ppmw] | 19 | 1.5 |
| Ni [ppmw] | 1.2 | 0.8 |
| Cu [ppmw] | 0.8 | 0.6 |
| B [ppmw] | 4.4 | 1.9 |
| As, B, Ba, Cd, Co, Li, Mn, Mo, Sr, V [ppmw] | <0.2 | <0.2 |
| Be, Bi, Pb, Sb, W [ppmw] | <0.2 | <0.2 |

The screening results achieved with respect to particle size distribution are shown in Tables 2d and 2e.

TABLE 2d

| | Chunk size 2 | Chunk size 1 | Chunk size 0 | Chunk size F |
|---|---|---|---|---|
| 5% by weight length quantile [mm] | 10 | 3 | 0.5 | 0.11 |
| 95% by weight length quantile [mm] | 40 | 15 | 5 | 0.81 |

TABLE 2e

| | CS 2/1 | CS1/0 | CS0/F |
|---|---|---|---|
| Overlap of 5% by weight/ 95% by weight [mm] | 5 | 2 | 0.31 |

The overlap is much higher than in example 1. This is attributable to the altered parameters in the screening machine, especially to the lower screening index.

Table 2f shows the contaminations of the classified chunks by surface metals, carbon, dopants and fine dust.

TABLE 2f

| Surface contaminations | Chunk size 2 | Chunk size 1 | Chunk size 0 | Chunk size F |
|---|---|---|---|---|
| Fe [pptw] | 200 | 340 | 1640 | 19,800 |
| Cr [pptw] | 30 | 50 | 310 | 11,000 |
| Ni [pptw] | <10 | 40 | 180 | 6800 |
| Na [pptw] | 40 | 50 | 480 | 7900 |
| Zn [pptw] | 20 | 30 | 360 | 6100 |
| Al [pptw] | 70 | 120 | 160 | 8400 |
| Cu [pptw] | <10 | 20 | 60 | <5000 |
| Mg [pptw] | <10 | 30 | 80 | 9700 |
| Ti [pptw] | <10 | 40 | 160 | <5000 |
| W [pptw] | 1640 | 5830 | 60,700 | 1,067,000 |
| K [pptw] | 10 | 30 | 140 | <5000 |
| Ag [pptw] | <10 | <10 | <10 | <5000 |
| Ca [pptw] | 50 | 130 | 380 | <5000 |
| Co [pptw] | 300 | 790 | 11,300 | 12,800 |
| V [pptw] | <10 | <10 | 100 | <5000 |
| Pb [pptw] | <10 | 20 | 80 | <5000 |
| Zr [pptw] | <10 | <10 | 670 | <5000 |
| Mo, As, Be, Bi, Cd, In, Li, Mn, Sn [pptw] | <10 | <10 | <10 | <5000 |
| C [ppbw] | 103 | 387 | 1431 | 7299 |
| B [pptw] | 6 | 16 | 48 | 133 |
| P [pptw] | 32 | 164 | 216 | 614 |
| As [pptw] | 2 | 8 | 22 | 60 |
| Fine dust [ppmw] | 4.8 | 11.5 | 19.3 | 44.2 |

The contaminations are higher throughout than in example 1. This shows the influence of the composition of the screen linings on the surface contamination of the chunks after classification.

Example 3

Table 3a shows the essential parameters of the screening machine.

TABLE 3a

| | |
|---|---|
| Screen width b [mm] | 500 |
| Screen length l [mm] | 1100 |
| Frequency n [Hz] | 24.3 |
| Rotational speed [rpm] | 1460 |
| Angular velocity ω [1/s] | 152.9 |
| Stroke [mm] | 2.4 |
| Amplitude r [mm] | 1.2 |
| Angle of inclination β [°] | 3 |
| Throwing angle α [°] | 40 |
| Screening index Kv [—] | 1.95 |
| Si-throughput [kg/h] | 1000 |
| $N_2$ sifting gas [$m^3$ (STP)/h] | 55 |

Table 3b shows which screen set was used in example 3. Three screen decks with different mesh sizes of the screens were used.

TABLE 3b

| | Mesh size [mm] | Material |
|---|---|---|
| Deck 1 | 9 | polyurethane |
| Deck 2 | 4.0 | polyamide |
| Deck 3 | 0.75 | polyamide |

Table 3c shows the composition of the screen linings.

TABLE 3c

| Element: | Polyurethane: | Polyamide: |
|---|---|---|
| Al [ppmw] | 17.1 | <0.2 |
| Ca [ppmw] | 11.3 | 18.6 |
| Cr [ppmw] | <0.2 | <0.2 |
| Fe [ppmw] | 0.6 | 0.3 |
| K [ppmw] | 0.9 | NN |
| Mg [ppmw] | 0.3 | 0.2 |
| Na [ppmw] | 0.4 | 0.9 |
| P [ppmw] | 53.2 | <20 |
| Sn [ppmw] | 5.8 | NN |
| Ti [ppmw] | 560 | <0.2 |
| Zn [ppmw] | 7.5 | <0.2 |
| B, Ba, Cd, Co, Cu, Li, Mn, Mo, Ni, Sr, V [ppmw] | <0.2 | <0.2 |
| As, Be, Bi, Pb, Sb, W [ppmw] | <0.2 | NN |

The results achieved with respect to particle size distribution are shown in tables 3d and 3e.

TABLE 3d

| | Screen undersize (<0.75 mm) | Screen target size (0.75-4 mm) | Screen oversize (4-9 mm) | Waste (>9 mm) |
|---|---|---|---|---|
| 5% by weight quantile [mm] | 0.35 | 0.81 | 3.61 | NN |
| 95% by weight quantile [mm] | 0.79 | 2.86 | 7.68 | NN |

TABLE 3e

| | Screen target size/screen undersize | Screen oversize/screen target size |
|---|---|---|
| Separation sharpness [—] | 0.862 | 0.876 |

Table 3f shows the contaminations of the classified granules by surface metals, carbon, dopants and fine dust.

TABLE 3f

| Surface metals: | Screen undersize (<0.75 mm) | Screen target size (0.75-4 mm) | Screen oversize (4-9 mm) |
|---|---|---|---|
| Fe [pptw] | 1700 | 860 | 380 |
| Cr [pptw] | 150 | 100 | 80 |
| Ni [pptw] | 120 | 80 | 40 |
| Na [pptw] | 390 | 230 | 150 |
| Zn [pptw] | 2620 | 2120 | 1530 |
| Al [pptw] | 260 | 150 | 140 |
| Cu [pptw] | 40 | 25 | 15 |
| Mg [pptw] | 120 | 70 | 60 |
| Ti [pptw] | 210 | 90 | 90 |
| W [pptw] | 60 | 50 | <10 |
| K [pptw] | 70 | 45 | 40 |
| Ca [pptw] | 580 | 360 | 320 |
| Mo, As, Sn, Ag, Co, V, Pb, Zr [pptw] | <10 | <10 | <10 |
| C [ppbw] | 564 | 252 | 204 |
| B [ppta] | 27 | 25 | 23 |
| P [ppta] | 123 | 120 | 114 |
| As [ppta] | 8 | 6 | 6 |
| Fine dust [ppmw] | NN | 3.6 | NN |

Comparative Example 4

Table 4a shows the essential parameters of the screening machine.

TABLE 4a

| | |
|---|---|
| Screen width b [mm] | 500 |
| Screen length l [mm] | 1100 |
| Frequency n [Hz] | 20 |
| Rotational speed [rpm] | 1200 |
| Angular velocity ω [1/s] | 125.7 |
| Stroke [mm] | 2.6 |
| Amplitude r [mm] | 1.3 |
| Angle of inclination β [°] | 3 |
| Throwing angle α [°] | 40 |
| Screening index Kv [—] | 1.4 |
| Si-throughput [kg/h] | 1000 |
| $N_2$ sifting gas [$m^3$ (STP)/h] | 45 |

Table 4b shows which screen set was used in comparative example 4. Three screen decks with different mesh sizes of the screens were used.

TABLE 4a

| | Mesh size [mm] | Material |
|---|---|---|
| Deck 1 | 9 | polyurethane |
| Deck 2 | 4.0 | polyamide |
| Deck 3 | 0.75 | polyamide |

Table 4c shows the composition of the screen linings used.

TABLE 4c

| Element | Polyurethane: | Polyamide: |
|---|---|---|
| Al [ppmw] | 57.2 | 1.3 |
| Ca [ppmw] | 45.2 | 32.5 |
| Cr [ppmw] | 1.5 | 1.3 |
| Fe [ppmw] | 14.0 | 3.1 |
| K [ppmw] | 6.5 | 0.4 |
| Mg [ppmw] | 3.6 | 1.4 |
| Na [ppmw] | 9.5 | 11.1 |
| P [ppmw] | 180 | 25.1 |
| Sn [ppmw] | 12.5 | 0.6 |
| Ti [ppmw] | 1400 | 0.3 |
| Zn [ppmw] | 25.3 | 5.8 |
| Ni [ppmw] | 0.7 | 0.6 |
| Cu [ppmw] | 0.5 | 0.3 |
| B [ppmw] | 5.3 | 0.4 |
| Ba, Cd, Co, Li, Mn, Mo, Sr, V, s, Be, Bi, Pb, Sb, W [ppmw] | <0.2 | <0.2 |

The screening results achieved with respect to particle size distribution are shown in Tables 4d and 4e.

TABLE 4d

| | Screen undersize (<0.75 mm) | Screen target size (0.75-4 mm) | Screen oversize (4-9 mm) | Waste (>9 mm) |
|---|---|---|---|---|
| 5% by weight quantile: [mm] | 0.38 | 0.74 | 3.56 | NN |
| 95% by weight quantile: [mm] | 0.78 | 2.63 | 7.30 | NN |

TABLE 4e

| | Screen target size/screen undersize | Screen oversize/screen target size |
|---|---|---|
| Separation sharpness [—] | 0.803 | 0.874 |

The separation sharpness in the case of screen target size/screen undersize is worse than in example 3. This is attributable to the lower screening index compared to example 3.

Table 4f shows the contaminations of the classified granules by surface metals, carbon, dopants and fine dust.

TABLE 4F

| Surface metals: | Screen undersize (<0.75 mm) | Screen target size (0.75-4 mm) | Screen oversize (4-9 mm) |
|---|---|---|---|
| Fe [pptw] | 3500 | 1490 | 720 |
| Cr [pptw] | 270 | 210 | 140 |
| Ni [pptw] | 300 | 150 | 80 |
| Na [pptw] | 750 | 530 | 520 |
| Zn [pptw] | 3270 | 2610 | 2230 |
| Al [pptw] | 360 | 220 | 170 |
| Cu [pptw] | 70 | 60 | 30 |
| Mg [pptw] | 610 | 320 | 130 |
| Ti [pptw] | 340 | 120 | 130 |
| W [pptw] | 50 | 50 | <10 |
| K [pptw] | 210 | 170 | 110 |
| Ca [pptw] | 2520 | 810 | 720 |
| Sn | 40 | 30 | <10 |
| Mo, As, Ag, Co, V, Pb, Zr [pptw] | <10 | <10 | <10 |
| C [ppbw] | 728 | 311 | 292 |
| P [ppta] | 202 | 148 | 133 |
| As [ppta] | 15 | 11 | 8 |
| Fine dust [ppmw] | NN | 8.3 | NN |

The contaminations are higher throughout than in example 3.

The measurement methods which follow were used to determine the parameters specified.

Contamination by carbon is determined by means of an automatic analyzer. This is described in detail in U.S. application Ser. No. 13/772,756, which is yet to be published, and in German application number 102012202640.1.

The dopant concentrations (boron, phosphorus, As) are determined to ASTM F1389-00 on monocrystalline samples.

The metal contaminations are determined to ASTM 1724-01 by ICP-MS.

The fine dust measurement is effected as described in DE 10 2010 039 754 A1.

The particle sizes (minimum chord) are determined by means of dynamic image analysis according to ISO 13322-2 (measurement range: 30 μm-30 mm, type of analysis: dry measurement of powders and granules).

The invention claimed is:

1. A method for decreasing an overlap of particle sizes between adjacent size fractions in mechanically classifying polycrystalline silicon chunks or granules with a vibratory screening machine, comprising:

introducing the chunks or granules into a gravity screening machine; setting the silicon chunks or granules present on one or more screens of the gravity screening machine in vibration, each screen comprising a screen lining such that the silicon chunks or silicon granules perform a throwing movement and which causes the silicon chunks or silicon granules to be separated into various size classes, wherein the screening index is greater than or equal to 1.6 and less than or equal to 3.0, and the screens of the gravity screening machine are characterized by an amplitude of vibration of 0.5 to 8 mm, a speed of rotation of 400 to 2000 rpm and a throwing angle of 30 to 60° relative to a screen plane, with the screen plane inclined by an angle of 0 to 15° relative to the horizontal.

2. The method of claim 1, wherein the screens of the gravity screening machine are characterized by an amplitude of vibration of 1 to 4 mm, a speed of rotation of 600 to 1500 rpm and a throwing angle of 40 to 50° relative to a screen plane, with the screen plane inclined by an angle of 0 to 10° relative to the horizontal.

3. The method of claim 1, wherein the screening machine comprises a plurality of screen decks arranged one on top of another.

4. The method of claim 2, wherein the screening machine comprises a plurality of screen decks arranged one on top of another.

5. The method of claim 1, wherein the screen linings are each secured on a frame of plastic or a frame comprising a plastic lining.

6. The method of claim 1, wherein one or more of the screen linings consist of an elastomer having a Shore A hardness of greater than 65 or have a surface composed of an elastomer having a Shore A hardness of greater than 65.

7. The method of claim 2, wherein one or more of the screen linings consist of an elastomer having a Shore A hardness of greater than 65 or have a surface composed of an elastomer having a Shore A hardness of greater than 65.

8. The method of claim 3, wherein one or more of the screen linings consist of an elastomer having a Shore A hardness of greater than 65 or have a surface composed of an elastomer having a Shore A hardness of greater than 65.

9. The method of claim 1, wherein one or more of the screen linings or the surfaces of one or more of the screen linings and all the further components and linings thereof that come into contact with the chunk silicon or granular silicon consist of plastics having a total contamination of less than 2000 ppmw.

10. The method of claim 3, wherein one or more of the screen linings or the surfaces of one or more of the screen linings and all the further components and linings thereof that come into contact with the chunk silicon or granular silicon consist of plastics having a total contamination of less than 2000 ppmw.

11. The method of claim 1, wherein perforated silicon fillets are used in one or more of the screen linings, holes in the silicon fillets, at least in part, having a conical shape.

12. The method of claim 1, wherein both perforated silicon fillets and plastic are used as screen linings, wherein a screen with a perforated Si fillet is used at least in a first screening step.

13. The method of claim 1, wherein the screens have orifices through which silicon chunks or granules smaller than the size of the orifices pass, the size of the orifices increasing in an outlet direction of the gravity screening machine.

14. The method of claim 1, further comprising dedusting the silicon chunks or granules being classified to remove fine silicon particles having sizes of less than 10 μm by directing a gas flow through the gravity screening machine to an off-gas exit, the gas velocity such that the fine silicon particles are entrained in the gas.

15. The method of claim 1, wherein the amplitude of vibration of screens of the gravity screening machine decreases in the direction of an outlet of the gravity screening machine.

16. The method of claim 1, wherein the weight percent overlap of one classified fraction with a next larger or smaller classified fraction is 5 weight percent or less based on the total weight of the one classified fraction.

* * * * *